United States Patent [19]

Palmer et al.

[11] Patent Number: 4,993,491

[45] Date of Patent: Feb. 19, 1991

[54] FRACTURE STIMULATION OF COAL DEGASIFICATION WELLS

[75] Inventors: Ian D. Palmer, Tulsa; David C. Gardner, Broken Arrow; Ralph W. Veatch, Tulsa, all of Okla.; G. Michael Kutas, Farmington, N. Mex.

[73] Assignee: Amoco Corporation, Chicago, Ill.

[21] Appl. No.: 342,407

[22] Filed: Apr. 24, 1989

[51] Int. Cl.[5] ..... E21B 43/267

[52] U.S. Cl. ..... 166/280; 166/308; 299/12

[58] Field of Search ..... 166/280, 308; 299/12

[56] References Cited

U.S. PATENT DOCUMENTS

| | | | |
|---|---|---|---|
| 2,354,570 | 7/1944 | Benckenstein | 166/280 X |
| 2,774,431 | 12/1956 | Sherborne | 166/280 |
| 3,075,581 | 1/1963 | Kern | 166/280 |
| 3,980,136 | 9/1976 | Plummer et al. | 166/280 |
| 4,126,181 | 11/1978 | Black | 166/280 |
| 4,186,802 | 2/1980 | Perlman | 166/280 |
| 4,442,897 | 4/1984 | Crowell | 166/280 |
| 4,471,840 | 9/1984 | Lasseter et al. | 166/280 |
| 4,566,539 | 1/1986 | Perlman | 166/380 X |
| 4,665,990 | 5/1987 | Perlman | 166/308 X |
| 4,679,630 | 7/1987 | Wyman | 166/308 X |

*Primary Examiner*—George A. Suchfield
*Attorney, Agent, or Firm*—Fred E. Hook

[57] ABSTRACT

This invention pertains to a novel method of fracturing subterranean coal formations as a means for stimulating the production of coalbed methane. A highly conductive proppant pack is emplaced in the fracture during the fracturing treatment that has a particle size gradient ranging from about 40/70 mesh at the leading tip of the fracture to about 12/20 mesh at the trailing base of the fracture. The fracturing process is conventional in the sense that the materials and equipment used in the process are well known. The manner in which such materials and equipment are used to fracture coal degasification wells is new.

11 Claims, No Drawings

FRACTURE STIMULATION OF COAL DEGASIFICATION WELLS

BACKGROUND OF THE INVENTION 1. Field of the Invention:

This invention pertains to a novel method of fracturing subterranean coal formations as a means for stimulating the production of coalbed methane. A highly conductive proppant pack is emplaced in the fracture during the fracturing treatment that has a particle size gradient ranging from about 40/70 mesh at the leading tip of the fracture to about 20/40 mesh at the trailing base of the fracture. 2. Description of the Prior Art:

Coal is the most abundant fossil energy resource in the world. Its recoverable reserves amount to almost 100 quintillion Btu of energy, nearly 15 times the total energy content estimated for known reserves of petroleum. *Petroleum Frontiers,* Vol. 3, No. 4, pages 2–3 (1986), published by Petroleum Information Corporation. People have mined coal and used it for heat for centuries. However, it is within the recent past that coal has been recognized for being the origin and source for another hydrocarbon fuel, i.e., coalbed methane. Coalbed gas consists primarily of methane (e.g., 95 percent) but may also contain ethane, propane and higher homologs. The volume of coalbed methane is estimated to be about 400 trillion standard cubic feet (SCF) of gas-in-place. Most of this gas is adsorbed on coal seams buried at a depth of less than about 9000 feet (ft) from the surface, and almost half of it is coal seams buried less than about 3000 ft. This coal is generally too deep to mine but easily penetrated by a wellbore using conventional drilling techniques. Coalbeds are, therefore, reservoirs and source rocks for a huge amount of gas which can be produced, in part, through a wellbore. Methods of recovering the gas (i.e., coal degasification methods) are shown, for example, by U.S. Pat. Nos. 4,471,840, 4,391,327 and 4,301,875.

The U.S. Department of Energy, the U.S. Bureau of Mines and the Gas Research Institute have funded a substantial amount of research on coal degasification, and the results have been published in the open literature. In addition, periodic coalbed methane symposiums are held at the University of Alabama, and elsewhere, and the results are published as symposium proceedings. Many of the journal articles describe stimulation techniques used by the industry to enhance production of gas. Conventional hydraulic fracturing techniques are the most common. In hydraulic fracturing, a fracturing fluid (e.g., an aqueous gel or an aqueous foam) is injected through a wellbore and against the face of the formation at pump rates and pressure sufficient to hydraulically fracture the formation. Typically, a proppant (e.g., 20/40 mesh sand, sintered bauxite, and the like) is blended with the fracturing fluid and is carried by the fluid into the fracture. When the pump rate and pressure are released, the fractured formation closes or heals onto the emplaced proppant in the induced fracture and a permeable communication channel is thereby established from the tip of the pack of proppant back to the wellbore. The formation fluids flow through this communication channel to the wellbore and are withdrawn.

Some of the previous methods of fracturing coal are shown below.

U.S. Pat. No. 4,471,840 (Lassiter) The coal formation is fractured by injecting (a) a pad fluid, (b) a proppant-laden fracturing fluid, and (c) an overflush of a proppant-free fluid through a well and into a coal seam.

U.S. Pat. No. 4,566,539 (Perlman) The coal formation is fractured by injecting alternating slugs of a proppant-laden fracturing fluid and a acidizing fluid through a well and into the coal seam.

U.S. Pat. No. 4,665,990 (Perlman) Essentially the same technique is used as in the preceding patent, but the focus here is on the amount of fine mesh size proppant (e.g., 100 mesh sand) emplaced in the fracture relative to the vertical thickness of the coal seam and also upon the size of the casing/tubing used to complete the well.

U.S. Pat. No. 4,679,630 (Wyman) The coal seam is fractured by injecting fracturing fluid through perforations located above and/or below the coal seam. The fracture propagates through the adjacent formation and then into the coal seam. This technique allegedly reduces plugging by coal fines.

Major problems have been encountered during the fracturing treatment in the forms of (a) very high high pressure build-up during pumping of the proppant-laden fracturing fluid, and (b) an excessive number of screenouts. A "screen out" occurs when proppant bridges over the fracture and prevents further introduction of fracture fluid into the treatment zone and prematurely stops the treatment. The pressure build-up (i.e., the proppant induced pressure increase) can range from several hundred to several thousand pounds per square inch (PSI) during typical fracturing operations using 12/20 mesh sand proppant and aqueous gelled fracture fluids. Such pressure increases may exceed the pressure limitations of the pumping equipment on tubulars, resulting in a "pressure out", and the pressure increases require additional hydraulic horsepower (i.e., pumping capacity) to pump the fracture fluids at required fracturing pressure and flow rates. This, in turn, substantially increases the cost of the well. Attempts to counter the proppant induced pressure increases by reducing the concentration of proppant in the fracture fluid have been only partially successful, and at an increased cost per well for the larger volumes of fracture fluid. In addition to the cost, the prior fracturing techniques for coal degasification wells are plagued by a tendency to screen out during the treatment.

With prior art fracturing techniques, screen out rates of about 50 to 60 percent on coal degasification wells are not uncommon. The economic loss associated with screen outs is substantial.

Summary of the Invention:

A new method of hydraulically fracturing subterranean coal formations has now been discovered. The method comprises the steps of:

(a) injecting a pad fluid through the well and into contact with said coal formation at a flow rate and pressure at least sufficient to fracture said coal formation; and (b) injecting a proppant-laden fracturing fluid into the fractured coal formation for a time sufficient to emplace a conductive proppant pack in said fracture coal formation that is in fluid communication with the wellbore;

said proppant-laden fracturing fluid having a graduated schedule of (i) increasing proppant mesh size, ranging from about 40/70 mesh to about 12/20 mesh, and (ii) increasing proppant concentration in the fracturing fluid.

The fracturing treatment is particularly effective in fracturing coal formations bounded by adjacent shale zones located above and/or below the coal. In such instances, the fracture created in the coal is typically confined or substantially confined to the region of the coal seam by adjacent shale zones.

The novel technique can be used to stimulate the production of coalbed methane from new wells or as a remedial treatment for existing wells of which production has declined.

The process advantages offered by the new technique include:

(a) higher concentration of proppant in the fracturing fluid, (b) reduced treating fluid requirements (i.e., volumes of fluid), (c) reduced pressure build-up during the fracturing treatment.

(d) reduced numbers of screen outs during fracturing, and These advantages are highly significant from a commercial standpoint.

As another aspect of the invention, the treated coal formation is also new. It is a subterranean earth formation comprising:

(a) a fractured subterranean coal formation containing recoverable coalbed methane;

(b) a coal degasification well penetrating said coal formation; and (c) a conductive proppant pack located in the fracture of said coal formation and having a proppant particle size gradient over the length of the fracture ranging from about 40/70 mesh at the leading tip of the fracture to about 12/20 at the trailing base of the fracture, said trailing base of the proppant pack being disposed toward said coal degasification well and in fluid communication with said well.

The treated formation has enhanced production of coalbed methane and other formation fluids. Production is also extended. The fracture(s) generated in the coal by our novel fracturing treatment are highly conductive; because of this, the wells are more quickly "dewatered" and production of coalbed methane is achieved sooner.

Detailed Description of the Invention:

The fracturing process is conventional in the sense that the materials and equipment used in the process are well known. The manner in which such materials and equipment are used to fracture coal degasification wells is new.

Fracture or fracturing fluids are typically referred to as "frac fluids" in the field. Such fluids are a known class of materials. The most widely used frac fluids are aqueous gels comprising water, a viscosifying material and, optionally, a crosslinking agent.

Typical viscosifying agents which can be utilized comprise solvatable polysaccharides which include galactommanan gums, glucomannan gums and cellulose derivatives. Examples of viscosifying agents useful herein include guar gum, locust bean gum, karaya gum, sodium carboxymethylguar, hydroxyethylguar, hydroxypropylguar, sodium carboxymethylhydroxypropylguar, sodium carboxymethylcellulose, sodium hydroxyethylcellulose, sodium carboxymethylhydroxyethylcellulose and the like. A sufficient quantity of the viscosifying agent, if desired, is admixed with the treatment fluid to provide a desired viscosity in the fluid. Typically from about 1 to about 100 pounds of the viscosifying agent can be admixed with each thousand gallons of treatment fluid to viscosify the fluid.

The treatment fluid can also include a cross-linking agent in addition to the viscosifying agent. The crosslinking agent can comprise any of the compounds known to crosslink the viscosifying agent in a useful manner to increase the viscosity of the treatment flud. Examples of crosslinking agents include organotitanates which feature the presence of titanium in the +4 oxidation state or zirconium chelates or salts which feature the presence of zirconium in the +4 oxidation state and the like. Borate salts can also be used as crosslinkers and are often preferred. Aqueous foams are also used extensively as fracturing fluids. Such foams comprise water, a foaming surfactant and a gas (e.g., nitrogen, carbon dioxide, normally gaseous hydrocarbons, and the like) and, optionally, a viscosify agent or a viscosifying agent and a crosslinking agent. Oil-in-water emulsions (e.g., diesel in an aqueous frac fluid) and other liquid/liquid emulsions (e.g., liquid carbon dioxide in an aqueous frac fluid) can also be used. Similarly, non-aqueous fracturing fluids are known and operable in the present invention. Examples of such non-aqueous fracturing fluids include gelled oil or diesel fluids, gelled alkanols (e.g., methanol, ethanol, and the like), and other such non-aqueous fluids. These non-aqueous materials can also be utilized as gas-in-liquid emulsions. The aqueous gels are preferred fracturing fluids based on current economics.

The proppants likewise form a known class of materials. Such materials include sand, sintered bauxite, glass beads, ceramics known as intermediate strength proppant and other like particulate materials. The proppants used herein are sized particles. The API gradations for proppant are 70/140, 40/70, 30/50, 20, 40, 12/20, 8/12 and 6/8. Essentially any proppant within these classifications can be used, but the preferred range is from 40/70 mesh for the smaller sized particles to 12/20 mesh for the larger particles. During the course of the fracturing treatment the smaller sized proppant is introduced first into the fracture and larger sized proppants are introduced subsequently. The proppant is blended with the frac fluid and pumped as a slurry into the well and against the coal formation to create the fracture. Conventional equipment is used to blend and pump the proppant-laden fracturing fluids. The proppant is usually blended with fracturing fluid "on-the-fly", i.e., while the fracturing fluid is pumped under pressure into and through the wellbore. The proppant is included in the fluid in a graduated schedule of increasing proppant mesh size, preferably ranging from about 40/70 mesh to about 12/20 mesh. The proppant is also normally included in the fluid in increasing solids concentrations in the fracturing fluid; i.e., increasing pounds of proppant per gallon of fracturing fluid. The blender described by Althouse in U.S. Pat. No. 4,453,829 and by McIntire in U.S. Pat. No. 4,614,435 is particularly well adapted for use in the present invention, but other conventional blending equipment can also be used to introduce the proppant according to a ramp function proppant schedule, a technique in which proppant concentrations are gradually increased on a substantially continuous manner or in small increments (e.g., 1 lb/gal increments). The proppant concentration is typically increased incrementally according to a ramp function proppant schedule from an initial loading of about 1-3 pounds of proppant per gallon of fracture fluid to a final loading of about 5-12 pounds per gallon. The conductivity of the emplaced proppant pack increases with increased amounts of larger particle-sized proppant in the pack. Also, the cost of the treatment goes up with increased volumes of fracturing fluid and hydraulic horsepower used. Accordingly, the size of the proppant and the concentration of the proppant in the fracturing fluid will each be increased during the treatment so as to put away the maximum amount of proppant with a minimum amount of fluid and minimum amount of pressure build-up beyond fracture pressure during the treatment.

Experimental:

Prior Procedure: Many coal degasification wells were fractured by pumping an aqueous fracturing fluid containing 30 pounds of hydroxypropylguar, a borate crosslinker, and a proppant (12/20 mesh sand) at a pump rate of 45 barrels per minute according to the following schedule:

TABLE I

| Stage | Fluid Volume (gallons) | Proppant (lbs) | Proppant Concentration (lbs/gallon) |
|---|---|---|---|
| 1 | 55,000 | 0 | 0 |
| 2 | 8,000 | 12,000 | 1.5 |
| 3 | 8,000 | 20,000 | 2.5 |
| 4 | 8,000 | 28,000 | 3.5 |
| 5 | 8,000 | 32,000 | 4.0 |
| 6 | 8,000 | 36,000 | 4.5 |
| 7 | 8,000 | 40,000 | 5.0 |
| 8 | 8,000 | 44,000 | 5.5 |
| | 111,000 gals | 212,000 lbs | |

Other pump schedules and design treatments were also used in the industry, but the above treatment was representative of the type used extensively in fracture stimulation of coal degasification wells in the San Juan Basin by Amoco and other major operators. Screenouts were common and occurred in as many as 50 to 60 percent of the fracturing treatments.

Comparative Procedure: A screenout also occurred when the procedure was modified to use different size proppant, as set forth in Table II.

TABLE II

| Stage | Fluid Volume (gallons) | Proppant (lbs) | Proppant Conc. (lbs/gal) | Proppant Size (mesh) |
|---|---|---|---|---|
| 1 | 40,000 | 0 | 0 | — |
| 2 | 4,000 | 6,000 | 1.5 | 20/40 |
| 3 | 4,000 | 10,000 | 2.5 | " |
| 4 | 4,000 | 14,000 | 3.5 | " |
| 5 | 4,000 | 14,000 | 3.5 | 12/20 |
| 6 | 6,000 | 24,000 | 4.0 | " |
| 7 | 6,000 | 27,000 | 4.5 | " |
| 8 | 6,000 | 30,000 | 5.0 | " |
| 9 | 6,000 | 33,000 | 5.5 | " |
| 10 | 3,670 | 0 | 0 | — |
| | 83,670 gal | 158,000 lbs | | |

In this treatment, the well screened out after only 60,942 gallons of fluid and 60,165 lbs of proppant had been pumped.

The following examples illustrate the present invention.

Example 1: This treatment followed essentially the same procedure except for the pump rate (50 barrels/-minute) and the initial proppant size. The treatment design is set forth in Table III.

TABLE III

| Stage | Fluid Volume (gallons) | Proppant (lbs) | Proppant Conc. (lbs/gal) | Proppant Size (mesh) |
|---|---|---|---|---|
| 1 | 34,000 | 0 | 0 | — |
| 2 | 3,000 | 3,000 | 1 | 40/70 |
| 3 | 3,000 | 6,000 | 2 | " |
| 4 | 3,000 | 9,000 | 3 | " |
| 5 | 3,000 | 12,000 | 4 | " |
| 6 | 4,000 | 20,000 | 5 | 12/20 |
| 7 | 4,000 | 24,000 | 6 | " |
| 8 | 4,000 | 28,000 | 7 | " |
| 9 | 5,000 | 40,000 | 8 | " |
| 10 | 5,000 | 45,000 | 9 | " |
| 11 | 5,000 | 50,000 | 10 | " |
| 12 | 6,000 | 66,000 | 11 | " |
| 13 | 7,000 | 84,000 | 12 | " |
| | 86,000 gal | 387,000 lbs | | |

The treatment progressed so well that stage 13 was extended by continuing to pump the 12 lb/gal slurry until available materials were consumed.

A total of 86,700 gallons of fluid and 429,800 lbs of proppant were actually pumped during the treatment. The fracturing treatment was successful in fracturing the coal formation and in emplacing a highly conductive proppant pack in the fractures. Formation fluids were readily produced through the well and no plugging by formation fines was observed.

Example 2: This treatment flow essentially the same procedure except for the pump rate (25 barrels/minute) and the incremental two-step increase in proppant size. Also, the pad fluid consisted of 18,000 gallons of a linear (i.e., uncrosslinked) gel and 70,000 gallons of a borate crosslinked gel, both containing 30 lbs of HPG per 1000 gallons of fluid.

The treatment design is set forth in Table IV.

TABLE IV

| Stage | Fluid Volume (gallons) | Proppant (lbs) | Proppant Conc. (lbs/gal) | Proppant Size (mesh) |
|---|---|---|---|---|
| 1 | 18,000 | 0 | 0 | — |
| 2 | 30,000 | 0 | 0 | — |
| 3 | 4,000 | 4,000 | 1.0 | 40/70 |
| 4 | 4,000 | 8,000 | 2.0 | " |
| 5 | 4,000 | 12,000 | 3.0 | 20/40 |
| 6 | 4,000 | 14,000 | 3.5 | " |
| 7 | 4,000 | 16,000 | 4.0 | " |
| 8 | 4,000 | 18,000 | 4.5 | 12/20 |
| 9 | 4,000 | 20,000 | 5.0 | " |
| 10 | 4,000 | 22,000 | 5.5 | " |
| | 80,000 gal | 114,000 lbs | | |

This early embodiment of the invention was successful in fracturing the coal seam and emplacing a highly conductive proppant pack in the fracture. The formation fluids were easily produced and no plugging by formation fines was observed. Later treatments, however, generally followed the preferred technique set forth in Example 1 because of economics; i.e., higher proppant concentrations of 12/20 sand in the slurry means that less aqueous fracture fluid is required to make the slurry and lesser total volumes of proppant laden fracturing fluid is pumped during the process. This saves money on materials and hydraulic horsepower. It was also observed that the proppant induced pressure increase was also substantially less when the fracture treatment was conducted according to the present process than by the Prior Procedure set forth above. This also saved money on hydraulic horsepower. In addition, the screenout rate has been reduced from about 50–60 percent with Prior Procedure to only 10–15 percent using the present technique. This reduced the number of remedial treatments and enhanced the economics substantially.

A combination of techniques illustrated in Example 1 and 2 is generally preferred for (a) fracturing coal seams estimated to be particularly difficult to fracture initially and (b) for remedial treatments (i.e., refracturing) of existing coal degasification wells. In these situations the treatment design illustrated by Example 1 would typically be modified to include the incremental two-step increase in proppant size.

What is claimed is:

1. A method of placing a conductive proppant pack while hydraulically fracturing a subterranean coal formation penetrated by a coal degasification well, said method comprising the steps of:

continuously injecting a pad fluid through the well and into contact with said coal formation at a flow rate and pressure at least sufficient to fracture said coal formation and thereafter injecting a proppant-laden fracturing fluid into the fractured coal formation for a time sufficient to emplace a conductive proppant pack in said fracture coal formation that is in fluid communication with the wellbore;

said proppant-laden fracturing fluid having a graduated schedule of (i) increasing proppant mesh size, ranging from about 40/70 mesh to about 12/20 mesh, and (ii) increasing proppant concentration in the fracturing fluid.

2. The method defined by claim 1 wherein said coal formation is bounded by adjacent shale zones above and/or below the coal formation.

3. The method defined by claim 2 wherein a fracture is created within the coal formation and wherein said vertical fracture is confined or substantially confined to the region of the coal seam by the adjacent shale zones.

4. The method defined by claim 1 wherein the size and concentration of the proppant are increased according to a ramp function proppant schedule.

5. The method defined by claim 1 wherein the fracturing fluid is an aqueous gel.

6. The method defined by claim 1 wherein the fracturing fluid is a stable acqueous foam.

7. A remedial treatment for a coal degasification well having a propped fracture within a subterranean coal formation in fluid communication with the wellbore, wherein a conductive proppant pack is placed in a propped fracture, which comprises the steps of:

continuously injecting a pad fluid through the well and into contact with said coal formation at a flow rate and pressure at least sufficient to fracture said coal formation and thereafter injecting a proppant-laden fracturing fluid into the fractured coal formation for a time sufficient to emplace a conductive proppant pack in said fractured coal formation that is in fluid communication with the wellbore;

said proppant-laden fracturing fluid having a graduated schedule of (i) increasing proppant mesh size, ranging from about 40/70 mesh to about 12/20 mesh, and (ii) increasing proppant concentration in the fracturing fluid.

8. A method of producing coalbed methane from a subterranean coal formation penetrated by a coal degasification well, wherein a conductive proppant pack is placed in a fracture extending from the coal degasification well into the subterranean coal formation, said method comprising the steps of:

continuously injecting a pad fluid through the well and into contact with said coal formation at a flow rate and pressure at least sufficient to fracture said coal formation and thereafter injecting a proppant-laden fracturing fluid into the fractured coal formation for a time sufficient to emplace a conductive proppant pack in said fractured coal formation that is in fluid communication with the wellbore;

said proppant-laden fracturing fluid having a graduated schedule of (i) increasing proppant mesh size, ranging from about 40/70 mesh to about 12/20 mesh, and (ii) increasing proppant concentration in the fracturing fluid;

(c) permitting said fractured formation to at least partially close upon said proppant pack; and (d) recovering produced fluids from the well.

9. In the method of fracturing a subterranean coal-containing formation to permit the removal of coalbed methane and other fluids from the formation, wherein a conductive proppant pack is placed in a fracture extending from a coal degasification well into the coal-containing formation, which comprises:

(a) introducing a treatment fluid into said subterranean formation at a rate and pressure sufficient to create at least one fracture in said coal-containing formation;

(b) continuously introducing a quantity of a proppant into said fracture in said coal-containing formation; permitting at least a portion of said proppant to settle within said fracture;

(c) introducing a substantially proppant-free fluid into said fracture to create a substantially proppant-free channel in an upper portion of said fracture above said settled proppant; and (d) permitting said fracture to close upon said propping agent to create a conductive channel through which coalbed methane and other fluids present in said formation can flow for removal from said subterranean coal-containing formation;

the improvement consisting of introducing the proppant in step (b) according to a graduated schedule of increasing proppant mesh size, ranging from about 40/70 mesh to about 12/20 mesh.

10. In the method of producing coalbed methane and other fluids present in a subterranean coal-containing formation penetrated by a wellbore from said formation, wherein a conductive proppant pack is placed in a fracture extending from the wellbore into the coal-containing formation which comprises:

(a) introducing a treatment fluid into said subterranean formation through said wellbore at a rate and pressure sufficient to create at least one fracture in said subterranean formation;

(b) while maintaining said fracture in an open position, continuously introducing a quantity of a proppant into said fracture in admixture with a quantity of said treatment fluid;

(c) permitting at least a portion of said proppant to settle to a lower portion of said open fracture;

(d) introducing a substantially proppant-free fluid into said open fracture to create a channel above said settled proppant which is substantially free of proppant; and (e) permitting said open fracture to at least partially close upon said proppant to form a propped channel in said subterranean formation through which formation fluids can flow for recovery from said subterranean formations;

the improvement consisting of introducing the proppant in step (b) according to a graduated schedule of increasing proppant mesh size, ranging from about 40/70 mesh to about 12/20 mesh.

11. A subterranean earth formation comprising:

(a) a fractured subterranean coal formation containing recoverable coalbed methane;

(b) a coal degasification well penetrating said coal formation; and (c) a conductive proppant pack placed in the fracture of said coal formation during a single fracturing treatment and having a proppant particle size gradient over the length of the fracture ranging from about 40/70 mesh at the leading tip of the fracture to about 12/20 mesh at the trailing base of the fracture, said trailing base of the proppant pack being disposed toward said coal degasification well and in fluid communication with said well.

* * * * *